US005563356A

United States Patent [19]

Mussi et al.

[11] Patent Number: 5,563,356

[45] Date of Patent: Oct. 8, 1996

[54] PIPET WITH INDICIA OF SCALE GRADUATION MARKING LOCATION

[75] Inventors: Edward F. Mussi, Saline, Mich.; Timothy P. Steele, Augusta, N.J.

[73] Assignee: Becton, Dickinson and Company, Franklin Lakes, N.J.

[21] Appl. No.: 491,189

[22] Filed: Jun. 16, 1995

[51] Int. Cl.[6] ..... B01L 3/02

[52] U.S. Cl. ..... 73/864.14

[58] Field of Search ..... 73/864.01–864.03, 73/864.11, 864.14; 422/100, 104; 206/569, 571, 305, 223

[56] References Cited

U.S. PATENT DOCUMENTS

| | | | |
|---|---|---|---|
| 3,258,972 | 7/1966 | Cassaday et al. | 73/864.01 |
| 3,651,615 | 3/1972 | Bohner et al. | 206/571 |
| 4,877,585 | 10/1989 | Perlman | 73/864.01 |
| 5,332,092 | 7/1994 | Fischer | 206/305 |

OTHER PUBLICATIONS

American Society for Testing and Materials (ASTM), Standard No. E934–85, Standard Specification for Serological Pipet, Disposable Plastic, pp. 806–807.

*Primary Examiner*—Robert Raevis
*Attorney, Agent, or Firm*—Arthur D. Dawson

[57] ABSTRACT

A pipet for transferring fluids of the present invention includes a distal tip, a barrel portion with an exterior surface, and a proximal neck. The pipet has a hollow bore. There are graduation markings on the exterior surface of the barrel portion for determining a volume of a fluid contained in the pipet. The graduation markings have a longitudinal and a radial orientation about the barrel. The pipet of the invention further includes a proximal mark for indicating the radial orientation of the graduation markings on the barrel that allows an operator to mount the pipet in a pipetter with the packaging open only at the neck end of the pipet in the most favorable orientation for use.

2 Claims, 3 Drawing Sheets

24
25

PIPET WITH INDICIA OF SCALE GRADUATION MARKING LOCATION

FIELD OF INVENTION

The present invention relates to transfer pipettes "To Contain" or "To Deliver" fluids and more particularly to a serological pipet having indicia of the scale markings' radial orientation on the pipet.

BACKGROUND

Pipettes are widely used in many laboratory procedures. When pipettes are used in a serological laboratory, there is often a need to make sterile fluid transfers and the pipettes used are sterilized. In response to this need, several manufacturers produce disposable plastic serological pipettes in a variety of maximum capacities, e.g., 1, 2, 5, 10, 25, 50 and 100 milliliters (ml), etc., with intermediate volume scale markings in tenths, halves or other unit ml increments. The American Society for Testing and Materials (ASTM) describes the structure and marking of these pipettes in detail in ASTM Standard No. E 934-85. In order to facilitate handling the pipet and to avoid drawing fluid out of the pipet during filling, there is generally a space on the barrel between the end of the scale and the neck of the pipet. A pipet following the ASTM Standard No. E 934-85 has a minimum of 90 mm between the end of the scale and the top of the pipet.

Previously, it was common for the operator to apply suction to the pipet for drawing fluid into the pipet by placing the neck of the pipet in his mouth. The neck portion often still is referred to as the "mouthpiece." As a convenience, these pipettes are commercially available in sterile form and individual peel-open packages that maintain the sterility of the pipet contained until the package is opened. Most of these packages are formed from paper, nonwoven materials and plastic film. Most of these packaging materials are either opaque or translucent and it is generally not possible to read the scale on the pipet through the package.

Because of the well documented concerns about laboratory safety in oral pipetting, most laboratory protocols now prohibit oral pipetting and require the use of suction bulbs or mechanical pipetters. Thus, in many normal procedures, it is common to use these sterile pipettes with a mechanical pipetter, to draw and expel the fluids being handled. In these laboratory sterile protocols and practices, the operator opens only the top portion of the sterile package, exposes only the neck of the pipet and mounts the pipet into a holder on the pipetter using the wrapper to grasp the pipet. The operator only removes the balance of the of the package when ready to perform the fluid transfer.

Most commercially available pipettes have volume indicating markings that are best read from a particular angle. Thus, if the pipet is not mounted in the pipetter so that the markings are positioned to be easily read by the operator, the operator must either make the reading in a less than optimal position, increasing the possibility of reading error, or grasp the now uncovered pipet and rotate it within the holder to the optimal reading position. By grasping the uncovered pipet and rotating it, there is a distinct possibility that the pipet may be contaminated with microorganisms.

If a pipet had an indication of the radial orientation of the scale at the top portion, the operator could optimally place the pipet in the pipetter before complete removal of the package and eliminate a possible source of misreading or contamination. Such a pipet is described below.

SUMMARY

A pipet of the present invention for transferring fluids includes a distal tip, a barrel portion with an exterior surface and a proximal neck. The pipet has a hollow bore. There are graduation markings on the exterior surface of the barrel to enable an operator to determine a volume of fluid contained in the barrel. The graduation markings have both a longitudinal and a radial orientation about the barrel. The pipet of the present invention includes a proximal mark indicating the radial orientation of the graduation markings on the barrel.

By having a proximal mark indicating the radial orientation of the graduation markings on the barrel of the pipet the operator can position the pipet rapidly and precisely in a mechanical pipetter after opening only an end of the protective package and exposing the proximal portion, substantially reducing two potential sources of error in serological laboratory fluid handling procedures, i.e., misreading of volume due to reading error and microbiological contamination from an additional handling step of the operator grasping an uncovered pipet to radially reorient it in the pipetter.

DETAILED DESCRIPTION

Figure 1:
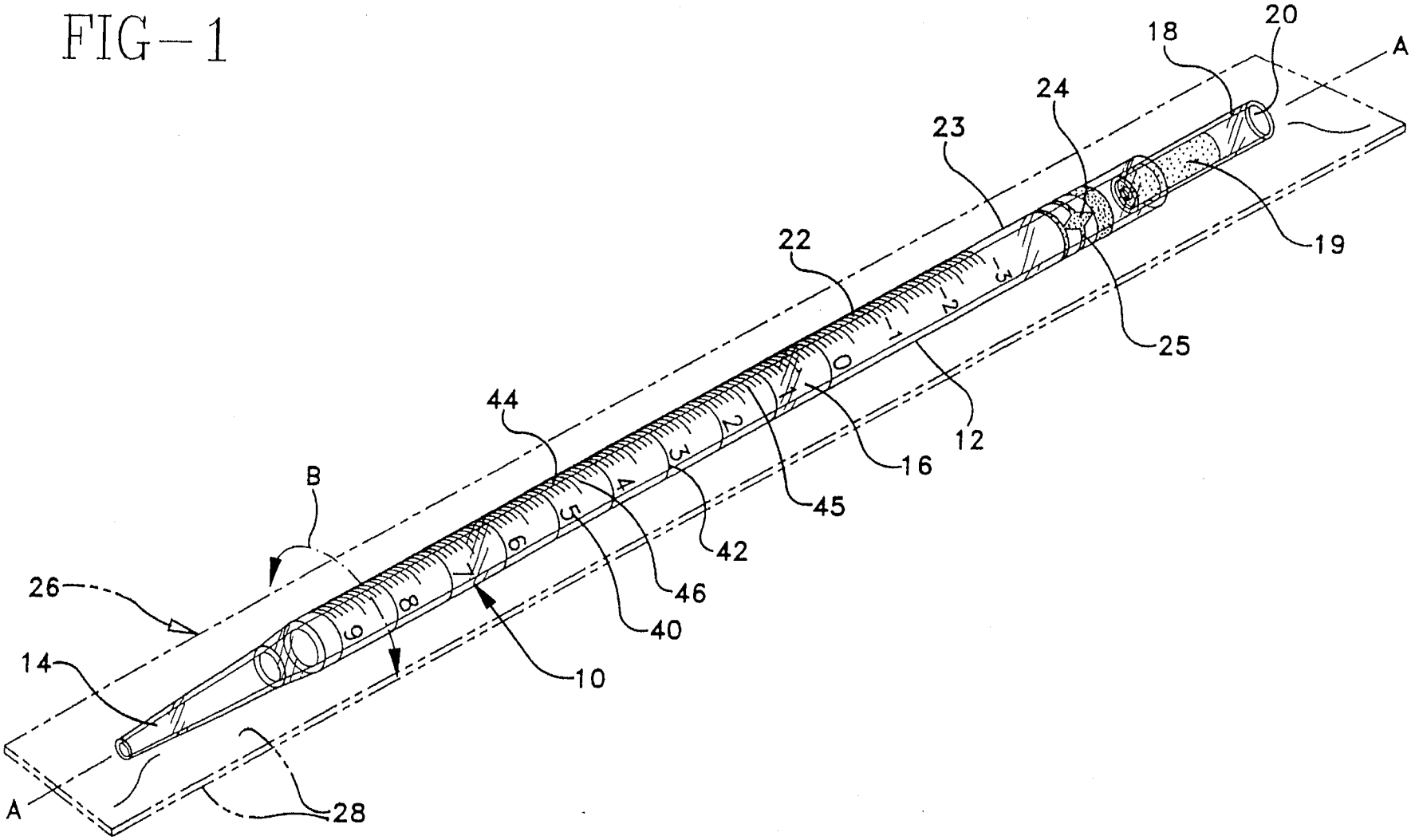
FIG. 1 is a perspective view of a pipet of the present invention.

While this invention is satisfied by embodiments in many different forms, there is shown in the drawings and will herein be described, several embodiments of the invention with the understanding that the present disclosure is to be considered descriptive of the principles of the present invention and is not intended to limit the scope of the invention to the embodiments illustrated. The scope of the invention is measured by the appended claims and their equivalents. In this description, the term "proximal" refers to the end of the pipet closest to the user, with the term "distal" referring to the end of the pipet away from the user.

Figure 2:
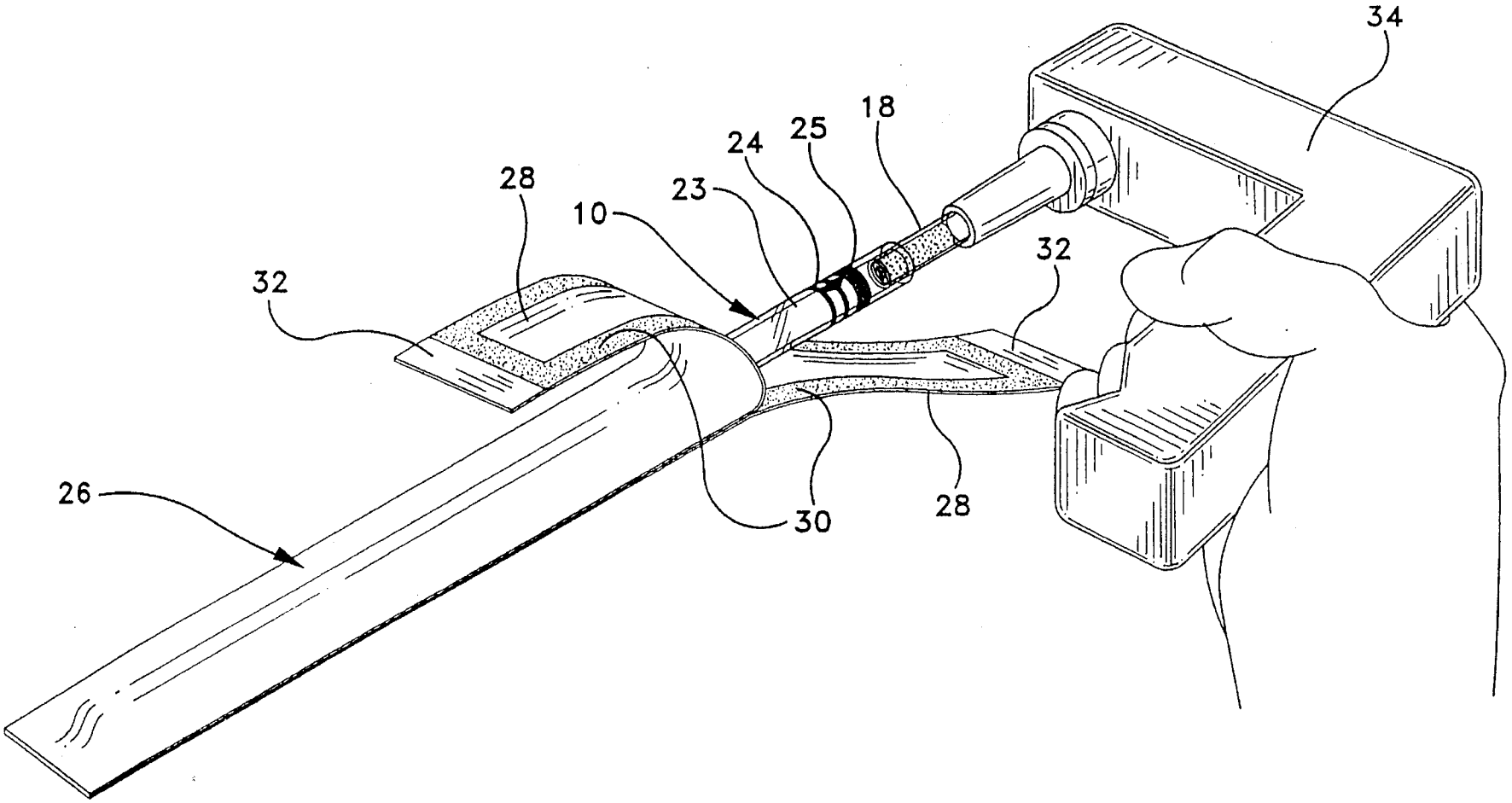
FIG. 2 is a perspective view of the pipet of FIG. 1 contained in a partially opened package and mounted in a mechanical pipetter.

As illustrated in FIGS. 1 and 2, a pipet 10 of the present invention for delivering fluids includes a distal tip 14, a barrel portion 16 with an outside surface 17 and a proximal neck 18. Pipet 10 has a hollow bore 200 Barrel 16 has graduation markings 22 for determining a volume of a fluid contained in the barrel. Graduation markings 22 have an orientation "A" longitudinally and "B" radially about the barrel. Preferably, pipet 10 of the present invention generally conforms to the provisions of ASTM Standard Specification E 934-85 for "Serological Pipet, Disposal Plastic." On a proximal portion 23 of the barrel of the preferred pipet there is a mark 24 indicating radial orientation "B" of graduation markings 22 about the barrel in addition to the markings 25 required by ASTM standard E-934-85 describing the pipet as a "To Deliver" pipet. The ASTM standard describes markings 25 as a "wide band or two narrow bands located at the top end to signify that the last drop must be blown out to achieve full delivery." According to the standard, all graduation markings of a serological pipet "shall be at least 90 mm below the top of the pipet on all sides."

Referring to FIGS. 1 and 2, preferred pipet 10 is contained in a sealed package 26 (shown in phantom in FIG. 1) formed from two elongate strips 28 of materials substantially resistant to the passage of microorganisms. Preferred package 26 includes a peelable adhesive bond 30 joining strips 28. Alter the pipet is sealed in the package, the package containing the pipet is preferably exposed to an environment capable of rendering any microorganisms inside the package nonviable. After such a treatment, the pipet is considered sterile as long as the package is intact. Suitable environments include, but are not limited to, ethylene oxide and ionizing radiation such as gamma or electron beam. Preferably, package 26 with pipet 10 therein is exposed to gamma irradiation. The packaging materials, the adhesive and materials used to form the pipet should be selected to be stable to the particular sterilization conditions employed.

As shown in FIG. 2, strips 28 preferably each include an unsealed surplus area 32 to enable a user to grasp the strips and peel them apart at adhesive bond 30 to expose only neck 18 and proximal portion 23 of the barrel of the pipet. The pipet is oriented within the package so that its neck is at the end of the package with the unsealed surplus area. The operator is then able to mount the pipet in a pipetter 34 by opening only the top portion of the package. When the operator mounts preferred pipet 10 in pipetter 34, he observes mark 24 and is able to orient the pipet in the pipetter according to his preference. The operator can orient the pipet so that graduation markings 22 are substantially optimally placed for determination of the fluid level in the pipet. Since, according to the standard, markings 22 are at least 90 mm below the top of the barrel, with the pipet of the present invention, the operator only needs to open only a small portion of the package to expose neck 118 and proximal barrel portion 23 and observe mark 24 of the preferred pipet to properly position the pipet. Previously, the operator either needed to open the package much further to expose the scale orientation or to reposition the pipet in the pipetter after removing the package.

FIGS. 3A–L, taken in conjunction with FIGS. 1 and 2, illustrate several configurations for the preferred integrated combination of the required markings 25 for a "To Deliver" pipet and the preferred mark 24 indicating radial orientation of graduation markings 22 about the barrel. Graduation markings 22 preferably include Arabic numerals 40 located proximally to respective major scale graduations 42 with intermediate scale graduations 44 and least scale graduations 45 between the major graduations. ASTM standard E 934-85 states that "intermediate graduation markings shall extend at least ⅓ of the way around the pipet and least scale graduations shall extend at least ⅐ of the way around the pipet." The standard further states that the graduations lines "shall be in a plane perpendicular to the longitudinal axis of the pipet parallel to each other." As is shown in FIGS. 1 and 2 and as an enlarged detail in 3*b*, preferred scale radial orientation mark 24 is integrated into required type markings 25 and radially aligned with the ASTM required Arabic numerals 40 and least scale graduations 45.

ASTM standard E 934-85 further requires that the pipettes have a wide band or two narrow bands on the "top end" to identify the pipet as a "To Deliver" pipet. A pipet of the "To Contain" type has no banding or other marks on the top. In the case of a "To Contain" pipet, the scale radial orientation mark 24 of the present invention would be alone on the proximal portion of the barrel or on the neck.

The preferred integration of preferred mark 24 into the required markings 25 for a "To Deliver" pipet allows the operator to rapidly confirm that the pipet he is mounting in the pipetter is the desired type and to radially orient the scale markings according to his needs or preference. It is intended that the scope of the present invention include other types of marks for indicating the radial orientation of the scale beyond those illustrated in the FIGS. 1, 2 and 3A–D. These other types include, but are not limited to, a break, i.e., an open unprinted area, in the required markings radially aligned with the scale markings as illustrated in FIGS. 3E–3H. The markings of the present invention further include, but are not limited to, radial orientation markings 24 not integrated with required markings 25 as is shown in FIGS. 3I, 3J, 3K and 3L. The radial orientation mark may also be applied to neck 18. Additionally the present invention includes, for particular applications, radially aligning mark 24 at a radial angle away from required Arabic numerals 40 and least scale graduations 42.

Figures 3A, 3B, 3C, 3D, 3E, 3F, 3G, 3H, 3I, 3J, 3K, 3L:
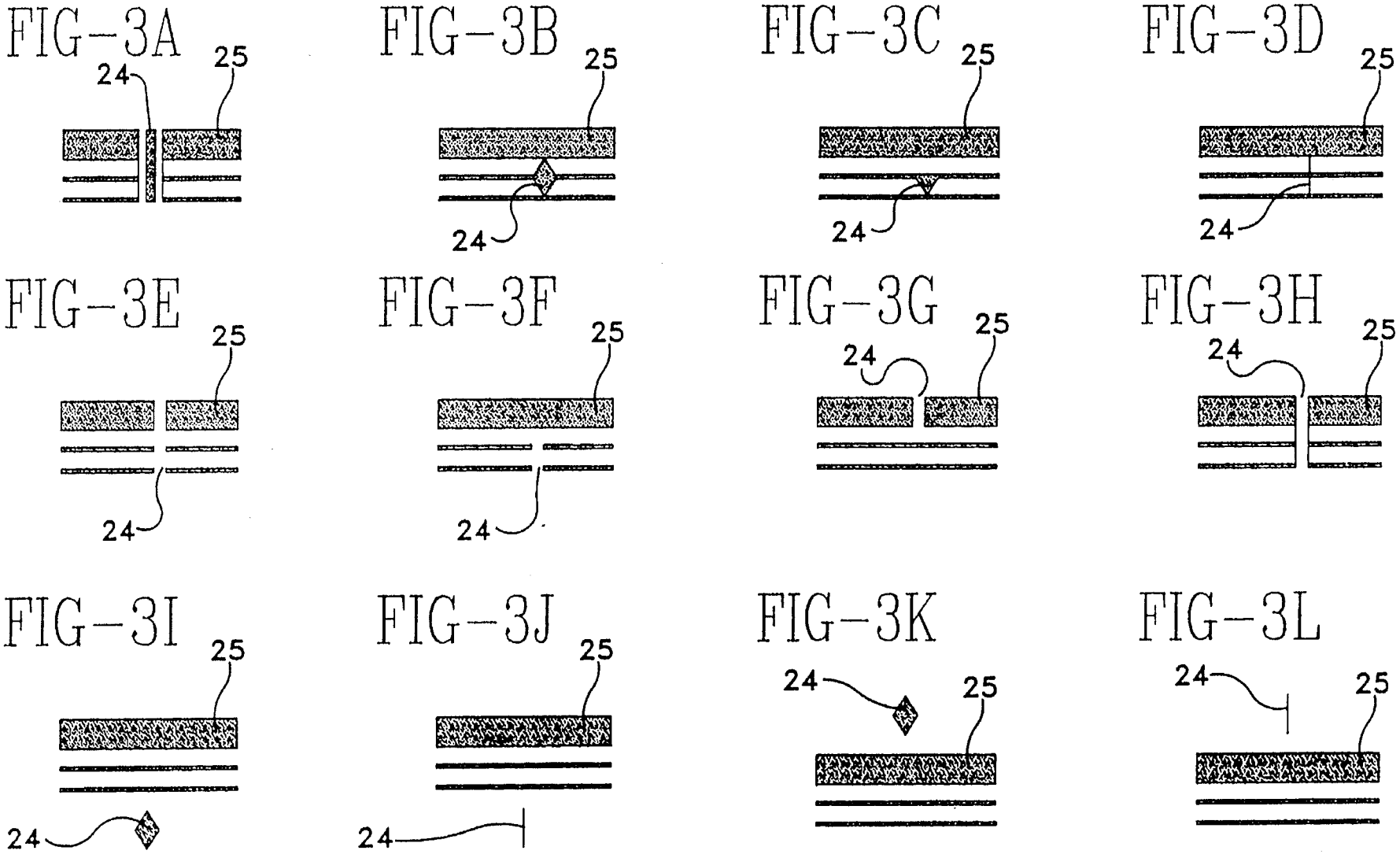
FIGS. 3A–3L illustrate examples of marks for the proximal portion of pipet of the present invention that provide indication of the scale marking radial orientation and pipet type.

The preferred radial orientation mark shown in FIGS. 1 and 2 and in detail in FIG. 3*b* was selected because it is easy to print and it reads well. Other marks may be preferred for particular applications. The preferred radial orientation mark is integrated into the required indicia designating the pipet as "To Deliver" i.e., a proximal wide annular band and two relatively narrower annular bands . These bands are substantially equally spaced on the proximal portion of the barrel. Mark 24 for indicating radial orientation "B" of graduation markings 22 preferably is a diamond shape having four points. The preferred diamond has two points on a shorter dimension, relative to a longer dimension of the diamond, aligned with a first narrower band intermediate the wide band and a second narrower band. The two points of the longer dimension of the preferred diamond longitudinally are then aligned with Arabic numerals 40 and an end 46 of the least scale graduations 42. Preferably, the longer dimension points are substantially between the wide band and the second narrower band.

Preferably, pipet 10 is substantially transparent and formed from crystalline polystyrene. Other materials such as polypropylene, polycarbonate, polyethylene, glass and the like are also suitable for forming pipettes of the present invention. Scale graduation markings, Arabic numerals, pipet type designations and preferred radial orientation mark 24 may be printed on an external surface of the barrel by a rotogravure, jet printer or any other similar process that produces legible markings. The markings may be embossed, debossed or machined into the surface of the pipet. The scale graduations, pipet type designations and radial orientation mark 24 may be printed in an ink of one color or in inks of contrasting colors. Preferably, the scale graduation markings are rotogravure printed in substantially opaque black ink with the required pipet type designations 25 and preferred radial orientation mark 24 printed in substantially opaque red ink. For particular applications, any other color or combination of colors may be employed. Additionally, the preferred pipet may include a volume designation, manufacturer's identification and the like, generally applied in the area between the end of the scale and the proximal end of the pipet.

Preferably, barrel 16 is produced by an extrusion process, with tip 14 and neck 18 formed by injection molding. Radial orientation mark 24 also may be molded into neck 18. Preferred pipet 10 is then assembled by bonding tip 14 and neck 18 onto barrel 16. Adhesive bonding, solvent bonding, ultrasonic bonding, or other known methods of bonding may be used for bonding tip 14 and neck 18 onto barrel 16. Ultrasonic bonding is preferably used to bond tip 14 and neck 18 onto barrel 16. Bore 20 at tip 14 preferably has an inside diameter smaller than an inside diameter of the bore at barrel portion 16 thus providing a flow restriction for fluid discharged from the pipet. Preferably, neck 18 includes a filter plug 19 in its bore to substantially avoid passage of particulates through the pipet. Plug 19 is preferably formed from absorbent cotton, but other materials such as viscose, polyester, open celled foams and the like are also suitable for forming plug 19.

Pipet 10 of the present invention may be provided in fractional ml capacities through capacities such as 1 ml, 5 ml, 10 ml, 15 ml, 20 ml, 25 ml, 50 ml, 100 ml or any other capacity useful for a particular application. Pipet 10 of the present invention provides an improvement to the art of sterile pipetting by substantially reducing a potential source of contamination and improving the efficiency of laboratory procedures by allowing an operator to accurately position the pipet in the pipetter while the package still protects the pipet.

What is claimed is:

1. A pipet for transferring fluids comprising:

a distal tip, a barrel portion having an exterior surface, and a proximal neck, said pipet having a hollow bore therethrough;

graduation markings about said barrel portion on said exterior surface for determining a volume of a fluid contained in said barrel portion, said graduation markings having an orientation longitudinally and radially about said barrel, and wherein a proximal portion of said barrel further comprises indicia designating said pipet to a type selected from the group consisting of "to deliver" a volume and "to contain" a volume, said pipet being contained within a sealed package substantially resistant to the transmission of microorganisms and exposed to an environment rendering any microorganisms therein substantially nonviable; and a proximal mark for indicating said radial orientation of said graduation markings on said barrel, and wherein said indicia for said pipet type and said mark for indicating said radial orientation of said graduation markings are integrated, said mark comprising an open unprinted area in said indicia when said pipet type is "To Deliver" so that when said package is opened to expose said proximal end of said pipet for mounting in a pipetting device, an operator may mount said in a preselected radial orientation.

2. A sterilized packaged pipet for delivering fluids comprising:

a tip, a barrel portion having an exterior surface, and a neck, said pipet having a longitudinal axis and a hollow bore therethrough;

graduation markings about said barrel portion for determining a volume of a fluid contained in said barrel portion, said graduation markings having an orientation longitudinally and radially about said barrel, said graduation markings including major scale graduations, intermediate scale graduations and least scale graduations, said graduations being in planes substantially perpendicular to said longitudinal axis and substantially parallel to each other, and numerals proximal to said major scale graduations for identifying said graduations;

a mark for indicating said radial orientation of said graduation markings and indicia designating said pipet to a type "to deliver" a volume, said radial orientation mark and said designating indicia being located on a proximal portion of said exterior barrel surface, wherein said indicia designating said pipet as "to deliver" comprises a proximal wide annular band and two relatively narrower annular bands, said bands being substantially equally spaced on said proximal portion of said barrel and said mark comprises a diamond shape having four points, two points on a shorter dimension relative to a longer dimension of said diamond aligned with a first narrower band intermediate said wide band and a second narrower band, with two points of said longer dimension longitudinally aligned with said numerals and an end of said least scale graduation, said longer dimension points being substantially between said wide band and said second narrower band; and a sealed package formed from materials substantially resistant to the transmission of microorganisms having said pipet sealed therewithin and having been exposed to an environment rendering any microorganisms therein substantially nonviable.

* * * * *